US009134015B2

(12) United States Patent
Guercio

(10) Patent No.: US 9,134,015 B2
(45) Date of Patent: Sep. 15, 2015

(54) MULTIPLE ANGLE MOUNTING ARM FOR LIGHT FIXTURES

(75) Inventor: Vincenzo Guercio, Wallkill, NY (US)

(73) Assignee: RAB Lighting Inc., Northvale, NJ (US)

( * ) Notice: Subject to any disclaimer, the term of this patent is extended or adjusted under 35 U.S.C. 154(b) by 582 days.

(21) Appl. No.: 13/533,403

(22) Filed: Jun. 26, 2012

(65) Prior Publication Data

US 2012/0325982 A1 Dec. 27, 2012

Related U.S. Application Data

(60) Provisional application No. 61/501,749, filed on Jun. 27, 2011.

(51) Int. Cl.

| | |
|---|---|
| ***E04G 3/00*** | (2006.01) |
| ***F21V 21/14*** | (2006.01) |
| ***F21V 31/00*** | (2006.01) |
| ***F21V 21/108*** | (2006.01) |
| ***F21V 21/116*** | (2006.01) |
| *F21V 21/12* | (2006.01) |
| *F21V 29/507* | (2015.01) |
| *F21V 29/75* | (2015.01) |
| *F21V 29/76* | (2015.01) |

(52) U.S. Cl.

CPC ..... *F21V 21/14* (2013.01); *F21V 21/108* (2013.01); *F21V 21/116* (2013.01); *F21V 31/005* (2013.01); *F21V 21/12* (2013.01); *F21V 29/507* (2015.01); *F21V 29/75* (2015.01); *F21V 29/763* (2015.01)

(58) Field of Classification Search

CPC ..... F21V 21/14; F21V 31/005; F21V 21/108; F21V 21/116; F21V 21/12; F21V 29/507; F21V 29/75; F21V 29/763

USPC ..... 248/49, 56, 57, 67.7, 68.1, 70, 201; 211/26, 99; 361/823, 826, 829; 362/418, 427

See application file for complete search history.

(56) References Cited

U.S. PATENT DOCUMENTS

| | | | | |
|---|---|---|---|---|
| 5,984,482 | A * | 11/1999 | Rumsey et al. | 359/871 |
| 8,262,265 | B2 * | 9/2012 | Hsieh | 362/427 |
| 8,770,530 | B2 * | 7/2014 | Bohanan et al. | 248/288.51 |

FOREIGN PATENT DOCUMENTS

| | | |
|---|---|---|
| CA | 2619334 | 7/2009 |
| DE | 4210625 | 10/1993 |

OTHER PUBLICATIONS

Stonco Floodpak Installation Instructions. [Retrieved on Sep. 4, 2012] [4 pages]. Retrieved from the Internet: <URL: www.floodpak.com/PDF/instructions%20UN-59-02553-000%20revB.pdf>.

*Primary Examiner* — Gwendolyn W Baxter

(74) *Attorney, Agent, or Firm* — SmithAmundsen LLC; Kelly J. Smith; Dennis S. Schell

(57) ABSTRACT

An illustrative mounting arm for a light fixture provides multiple tilt angles based on the selected orientation of components of the mounting arm. The mounting arm includes a first and second arm portion, each having opposite ends oriented at different relative angles to provide the multiple tilt angles for the light. A support end arm or second arm portion connects directly or indirectly to a wall or other support structure. An intermediate or first arm portion couples between the second arm portion and a mounting pad portion of the light fixture. Each of the first and second arm portions are rotatable in orientation, thus changing the orientation of the angle ends, each combination of possible arm portion orientations displacing the light fixture and therefore the illumination pattern at a different elevation angle relative to the support structure.

16 Claims, 15 Drawing Sheets

MULTIPLE ANGLE MOUNTING ARM FOR LIGHT FIXTURES

CROSS-REFERENCE TO RELATED APPLICATIONS

This application is a non-provisional of U.S. Provisional Patent Application 61/501,749, filed Jun. 27, 2011, and titled MULTIPLE ANGLE MOUNTING ARM FOR LIGHT FIXTURES, which is incorporated herein by reference in its entirety.

BACKGROUND

The present invention relates to mounting for light fixtures, and particularly, to mounting that provides adjustment of the direction of illumination from the light fixture.

SUMMARY

The present invention can comprise one or more of the features recited in the attached claims, and/or one or more of the following features and combinations thereof.

An illustrative mounting arm for a light fixture provides multiple tilt angles based on the selected orientation of components of the mounting arm. The mounting arm includes a first and second arm portion, each having opposite ends oriented at different angles to provide the multiple tilt angles. A support end arm or second arm portion connects directly or indirectly to a wall or other support structure. An intermediate or first arm portion couples between the second arm portion and a mounting pad portion of the light fixture. Each of the first and second arm portions are rotatable in orientation, thus changing the orientation of the angle ends, each combination of possible orientations displacing the light fixture and therefore the illumination pattern at a different elevation angle relative to the support structure.

One illustrative mounting arm for mounting a light fixture to a support structure in a plurality of tilt positions, includes a mounting pad defined by the light fixture; a first arm portion defining a first arm first end and a first arm second end, the first arm first end adapted to couple with the mounting pad; a second arm portion defining a second arm first end and a second arm second end, the second arm first end adapted to couple with the first arm second end, the second arm second end adapted to couple with a support structure; at least one of the first arm and second arm being capable of orientation between a first rotational position and a second rotational position; and wherein changing the orientation of one of the first arm or second arm from the first to the second rotational position tilts the light fixture from a first to a second of the plurality of tilt positions.

An illustrative mounting arm can also have rotational orientation of the first arm relative to the second arm providing at least four tilt positions of the light fixture based on the selected combination of the first arm rotated between a first and second rotational position and the second arm rotated between a first and second rotational position.

An illustrative mounting arm can also have relative rotational orientations of the first arm, second arm, and light fixture provide at least eight tilt positions of the light fixture based on the selected combination of the first arm rotated between a first and second rotational position, the second arm rotated between a first and second rotational position, and the light rotated between a first and second rotational position. Additionally, the first arm first end can define a first arm first end plane and the first arm second end can define a first arm second end plane, the first arm first end plane being non-parallel to the first arm second end plane. Additionally, the second arm first end can defined a second arm first end plane and the second arm second end can define a second arm second end plane, the second arm first end plane being non-parallel to the second arm second end plane.

An illustrative mounting arm can also include a longitudinal arm axis defined between the mounting pad and the second end of the second arm portion; and wherein changing the orientation of at least one of the first arm and the second arm between the first position and the second position rotates the respective arm about 180 degrees about the longitudinal arm axis. Additionally, the couplings between the mounting pad and first arm and the first arm and the second arm can be releasable.

An illustrative mounting arm and also include a lens defining a first plane; and wherein the mounting pad forms a second plane, and the first plane and the second plane are non-orthogonal. Additionally, the first end of the first arm can define a first arm first end plane which is oriented relative to the longitudinal axis of the first arm such that coupling of the mounting pad to the first arm first end plane positions the longitudinal axis perpendicular relative to the normal of the first plane of the lens.

Additionally, the first arm first end can define a first arm first end plane and the first arm second end can define a first arm second end plane, the first arm first end plane being non-parallel to the first arm second end plane; the second arm first end can define a second arm first end plane and the second arm second end defines a second arm second end plane, the second arm first end plane being non-parallel to the second arm second end plane; the orientation of each of the first arm and the second arm in one of the first and the second rotational positions can provide four orientation combinations, each of the four orientation combinations providing a different relative angular orientation between the first arm first end plane and the second arm second end plane.

Additionally, the first arm second end plane can be oriented relative to the longitudinal axis in a complementary angle to the second arm first end plane orientation relative to the longitudinal axis.

An illustrative mounting arm can further include an opening defined by each of the mounting pad, first arm first end, first arm second end, second arm first end, and second arm second end, the opening can be sized to allow passage of electrical wiring therethrough. An illustrative mounting arm can further include a watertight seal between each of the mounting pad and the first arm first end and first arm second end and second arm first end, around the respective openings. An illustrative mounting arm can further include a watertight seal between the second arm second end and the support structure around the opening defined by the second arm second end.

An illustrative mounting arm can further include a water seal; and a recess formed by one of the first arm second end and second arm first end, the recess encircling the opening defined by the same end; and wherein the water seal is positioned at least partially in the recess.

An illustrative mounting arm and further include a water seal; and a recess formed by the second arm second end and the recess encircles the opening defined by the second arm second end; wherein the water seal is positioned at least partially in the recess.

Additional features of the disclosure will become apparent to those skilled in the art upon consideration of the following detailed description of an illustrative embodiment.

BRIEF DESCRIPTION OF THE DRAWINGS

The detailed description particularly refers to the accompanying figures in which.

DESCRIPTION OF ILLUSTRATIVE EMBODIMENTS

Figure 1:
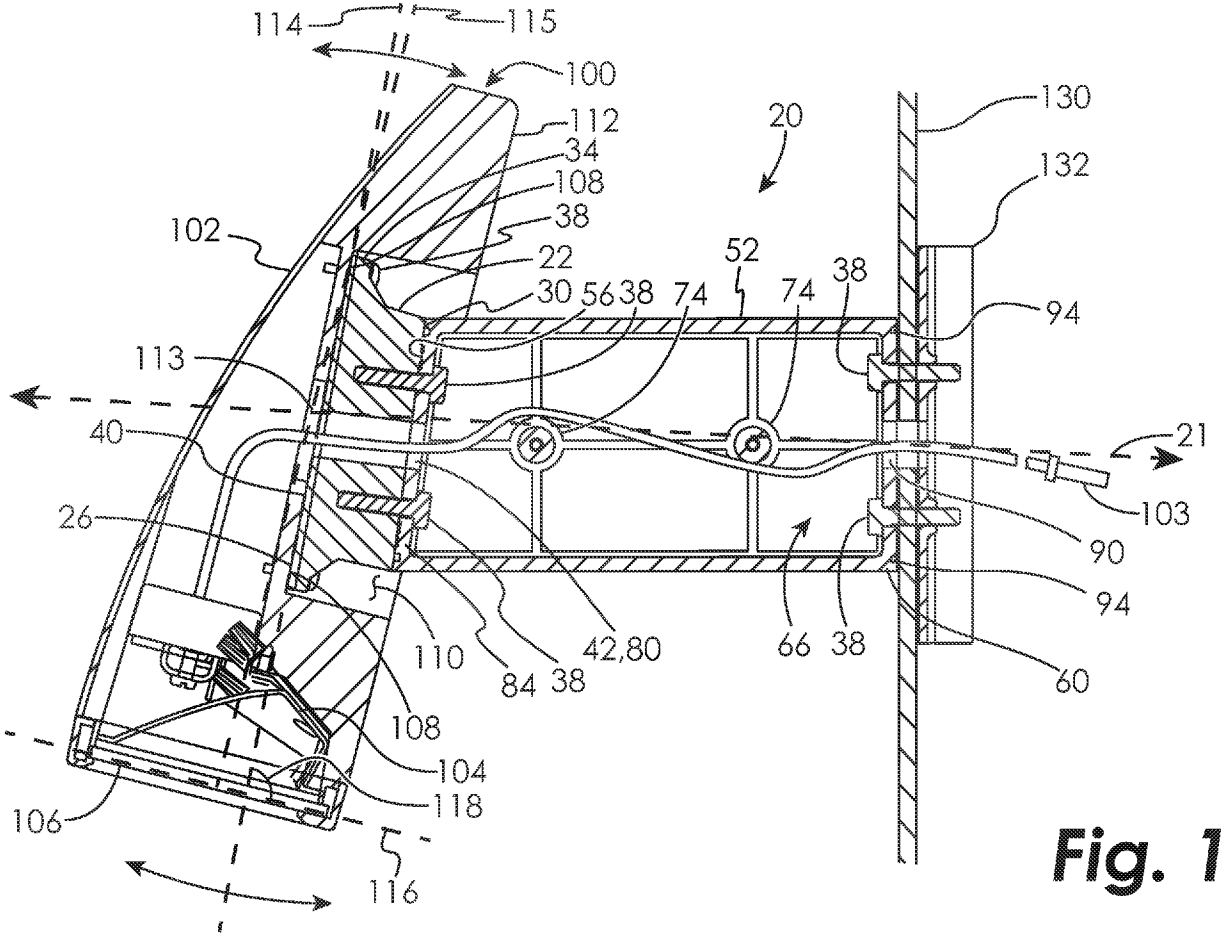
FIG. 1 is a cut-away side assembly view of an illustrative embodiment of a mounting arm according to the present invention shown with an illustrative light fixture and support structure.

For the purposes of promoting and understanding the principals of the invention, reference will now be made to one or more illustrative embodiments illustrated in the drawings and specific language will be used to describe the same.

Referring to FIG. 1, an illustrative embodiment of a mounting arm 20 is shown. The mounting arm 20 is used for mounting a light fixture 100 to a support structure 130, for example a wall, bollard, or other structure, and for positioning or repositioning the light fixture in elevation in one of a plurality of available tilt positions 121-128 (FIGS. 4-11) about a horizontal/tilt axis 113 (FIG. 2) of the light fixture. The illustrative light fixture 100 includes a housing 102, light source 104, lens (including, alternatively, simply an opening in the housing for transmittal of light) 106, and mounting pad 108 (FIG. 3), for example located in an opening defined within cooling fins 110 on the rear side 112 of the light fixture 100.

Figure 2:
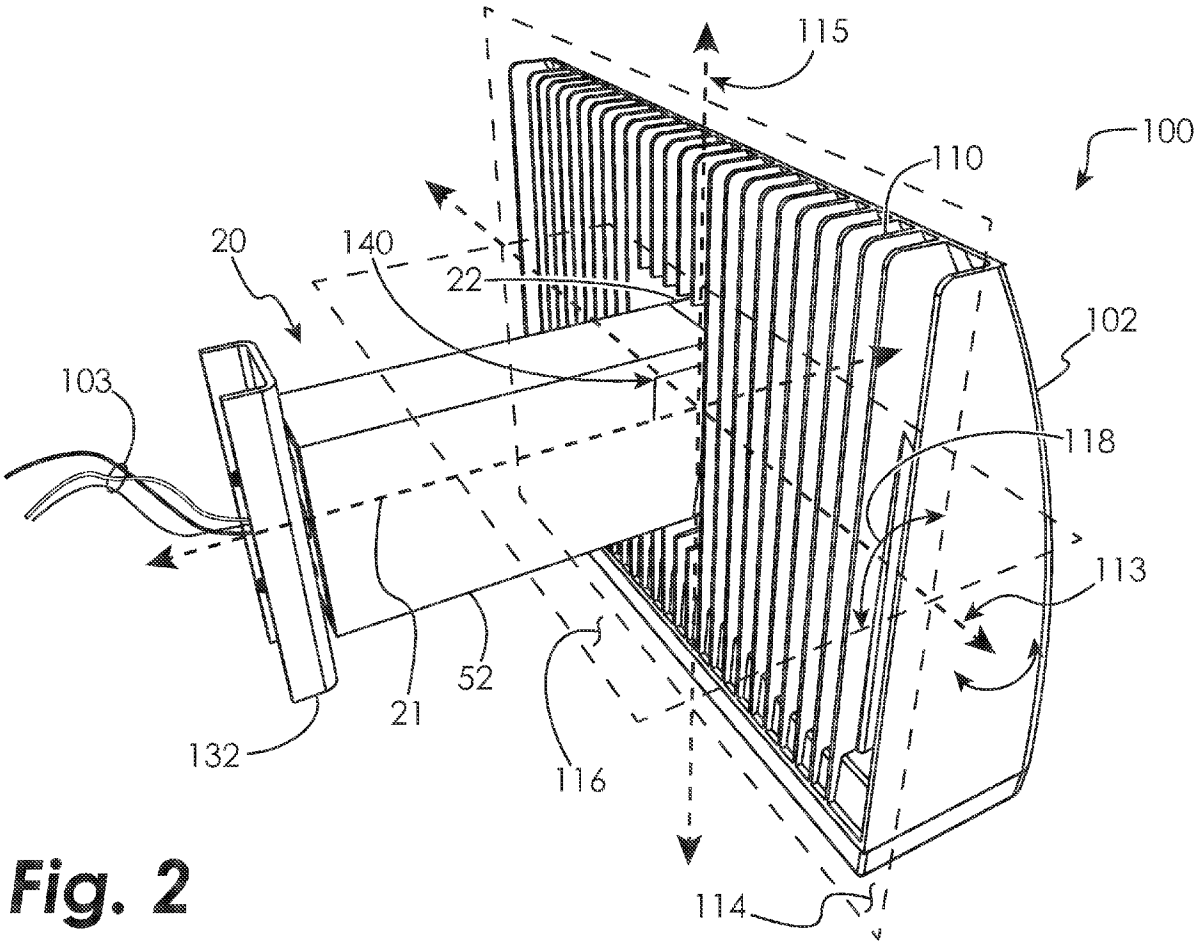
FIG. 2 is a rear perspective view of the illustrative embodiment of FIG. 1.

The mounting arm 20 includes multiple portions, for example, in the illustrative embodiment a first arm 22 and a second arm 52 extend about along a longitudinal axis 21. Prior art elevation tilting hardware typically includes, for example, a swinging pivot joint(s) that rotates the light about a pin(s) or axle(s) to provide adjustment of the light in elevation, also referred to as tilt. In contrast, in the illustrative embodiment of the mounting arm 20, tilting adjustment of the light fixture 100 is provided by changing the relative orientation of at least one of the first arm 22, second arm 52, and light fixture 100. Each arm 22 and 52 includes ends 26, 30, 56, and 60 (FIG. 12) defining different angles, the orientation of which provide the change in elevation of the light fixture 100 relative to the support structure 130. Although other changes in orientation are possible, in the illustrative embodiment each of the first arm 22, second arm 52, and light fixture 100, can be selectively rotated around the longitudinal axis 21, or about around the longitudinal axis 21. Thus adjustment is in twisting rotation or end-to-end rotation about around the longitudinal axis 21, which reorients the angled ends 26, 30, 56, and 60 (FIG. 12), rather than prior art examples of swinging adjustment of a mounting arm member about an axis parallel to tilt axis 113 (FIG. 2).

More specifically, referring to FIGS. 4-11, in the illustrative embodiment, two rotational orientations are available for each of the first arm 22, second arm 52, and light fixture 100. The possible combinations of orientations of the first arm 22, second arm 52, and light fixture 100 provide eight different tilt positions 121-128 (FIGS. 4-11) for the light fixture 100 relative to the support structure 130. For example, in FIGS. 4, 7, 8, and 11, first arm 22 is oriented in a first rotational position 23*a* and in FIGS. 5, 6, 9, and 10, first arm 22 is oriented in a second rotational position 23*b*, a twisting rotation of 180 degrees about around the longitudinal axis 21 from the first rotational position 23*a*. Similarly, in FIGS. 4, 5, 8, and 9, the second arm 52 is oriented in a first rotational position 53*a*, and in FIGS. 6, 7, 10, and 11, the second arm 52 is oriented in a second rotational position 53*b*, a twisting rotation of 180 degrees about around the longitudinal axis 21 from the first rotational position 53*a*. Additionally, in FIGS. 4-7, the light fixture 100 is oriented in a first rotational position 101*a*, in which light in projected generally downward relative to support structure 130, and in FIGS. 8-11, the light fixture 100 is oriented in a second rotational position 101*b*, a rotation of 180 degrees about around the longitudinal axis 21, in which light is cast generally upward relative to support structure 130.

Figure 3:
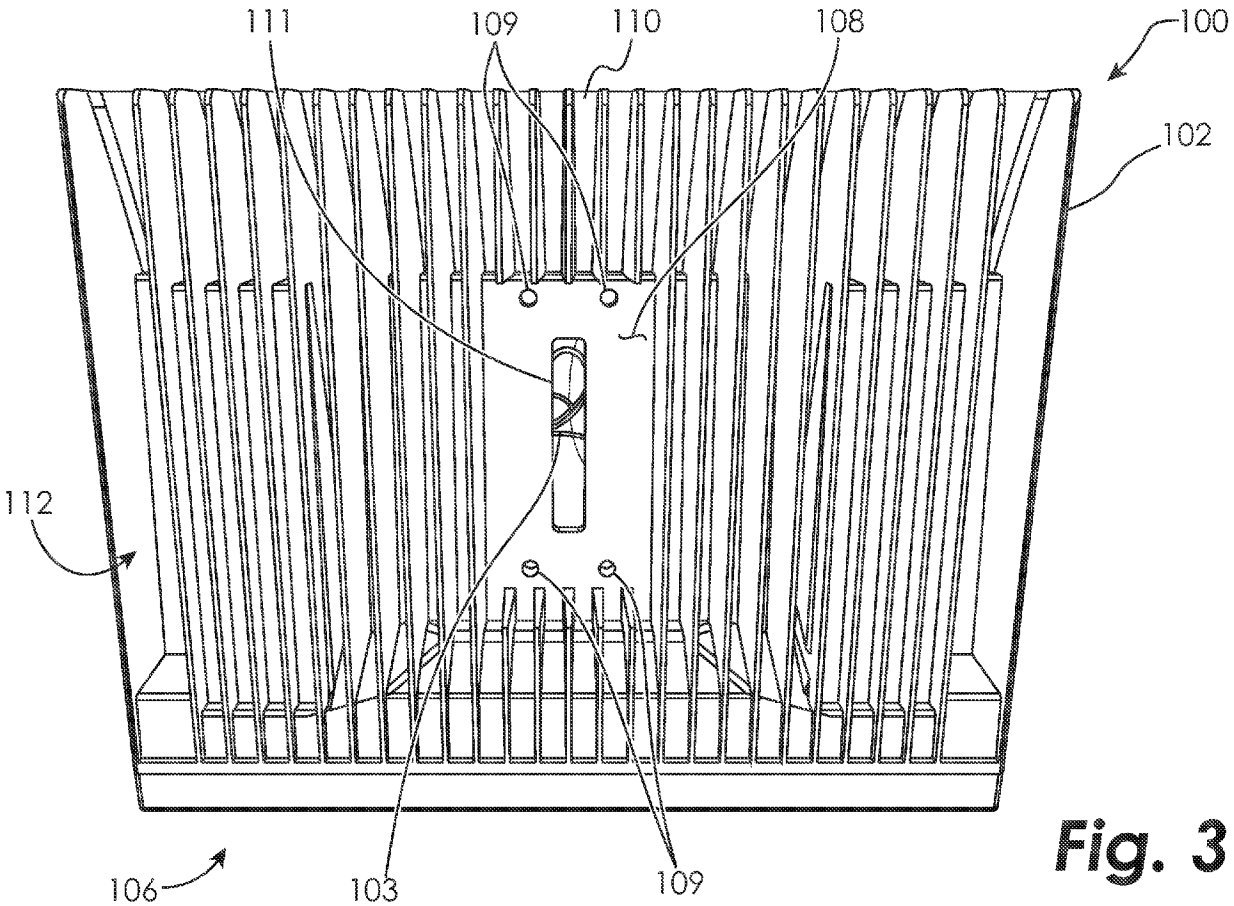
FIG. 3 is a rear view of the illustrative light fixture of FIG. 1 showing the mounting pad.

Referring to FIGS. 1 and 3, the mounting pad 108 is structured to provide coupling with the mounting arm 20. In the illustrative embodiment, a mounting pad plane 114 defined by the surface of the mounting pad 108 is tilted about axis 113 from the normal vector 115 to the lens plane 116 defined by the lens 106 (or the opening in housing 102 for the light source 104). Specifically, the surface of the mounting pad 108 is oriented so that the angle 118 between the mounting pad plane 114 and lens plane 116 is about 93 degrees, and thus a tilt of the lens 106 end of the light fixture 100 away from the support structure 130 of about 3 degrees. The light housing 102 further defines tapped bores 109 (FIG. 3) for releasably coupling mounting arm 20, and an opening 111 defined within mounting pad 108, the opening providing passage of electrical supply wires 103 therethrough. As is shown in FIG. 1, the orientation of the light source 104 can be different than that of lens plane 116.

In other embodiments, the mounting pad 108 can be oriented such that the mounting pad plane 114 is at a different angle relative to the normal line 115 to the lens plane 116. Additionally, or alternatively, the mounting pad 108 can include more than one location to which the mounting arm 20 can be coupled, each location providing a different tilt of mounting pad plane 114 relative to the lens plane 116.

Figure 12:
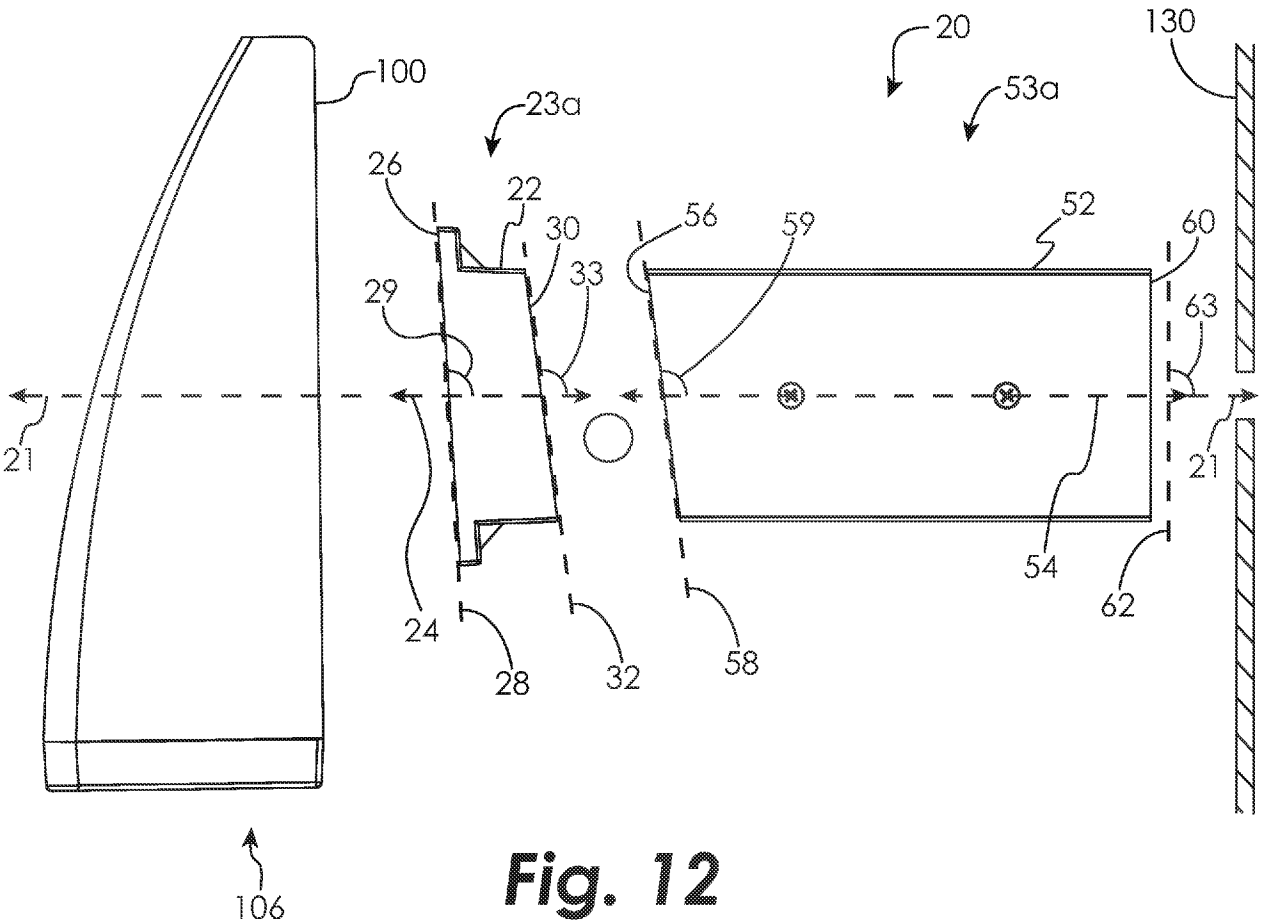
FIG. 12 is an exploded side view showing the end surface orientation of the first arm and second arm of the mounting arm of FIG. 1.

Referring to FIG. 12, orientation of end surfaces 26, 30, 56, and 60 of the first arm 22 and second arm 52 of the illustrative embodiment of the mounting arm 20 are shown. The first arm first end 26 and first arm second end 30 are located at opposite ends of the first arm 22. A longitudinal axis 24 is defined between the center of the first arm first end 26 and the first arm second end 30, and is about coaxial with axis 21 in the illustrative embodiment. The first end 26 defines a first arm first end plane 28 which in the illustrative embodiment is oriented at an angle 29 of about 93 degrees relative to the longitudinal axis 24, the angle 29 measured about a line parallel to the tilt axis 113 (FIG. 2). This angle 29 is optionally complementary with the orientation of the mounting pad plane 114 so that when the first rotational position 23*a* shown in FIG. 12, and the first end 26 is coupled with the mounting pad 108, the longitudinal axis 24 of the first arm 22 is perpendicular to the normal vector 115, and parallel to the lens plane 116.

The second end 30 defines a first arm second end plane 32 which in the illustrative embodiment is oriented at an angle 33 of about 97.5 degrees relative to the longitudinal axis 24, the angle 33 measured about a line parallel to the tilt axis 113. Other orientations for ends 26 and 32 and thus values for angles 29 and 33 for the first arm 22 can be used in other embodiments. The angles 29 and 33 can be equal, complementary, or different. In the illustrative embodiment, the angles 29 and 33 are different, thus the end planes 28 and 30 are non-parallel about the tilt axis 113.

The second arm first end 56 and second arm second end 60 are located at opposite ends of the second arm 52. A longitudinal axis 54 is defined between the center of the second arm first end 56 and the second arm second end 60, and is about coaxial with axis 21 in the illustration embodiment. The first end 56 defines a second arm first end plane 58, which in the illustrative embodiment is oriented at an angle 59 of about 97.5 degrees relative to the longitudinal axis 54, the angle 59 measured about a line parallel to the tilt axis 113. This angle 59 is optionally complementary with the orientation of the first arm second end 30 so that when the rotational positions of the first arm 22 and second arm 52 are the matching, i.e. either 23*a* and 53*a*, or 23*b* and 53*b*, the longitudinal axis 24 of the first arm 22 is coaxial with the longitudinal axis 54 of the second arm 52.

The second end 60 defines a second arm second end plane 62 which in the illustrative embodiment is oriented at an angle 63 of about 90 degrees relative to the longitudinal axis 54, the angle 63 measured about a line parallel to the tilt axis 113. Other orientations for ends 56 and 60 and thus values for angles 59 and 63 of the second arm 52 can be used in other embodiments. The angles 59 and 63 can be equal, complementary, or different. In the illustrative embodiment, the angles 59 and 63 are different, thus the end planes 28 and 30 are non-parallel about the tilt axis 113.

Figure 4:
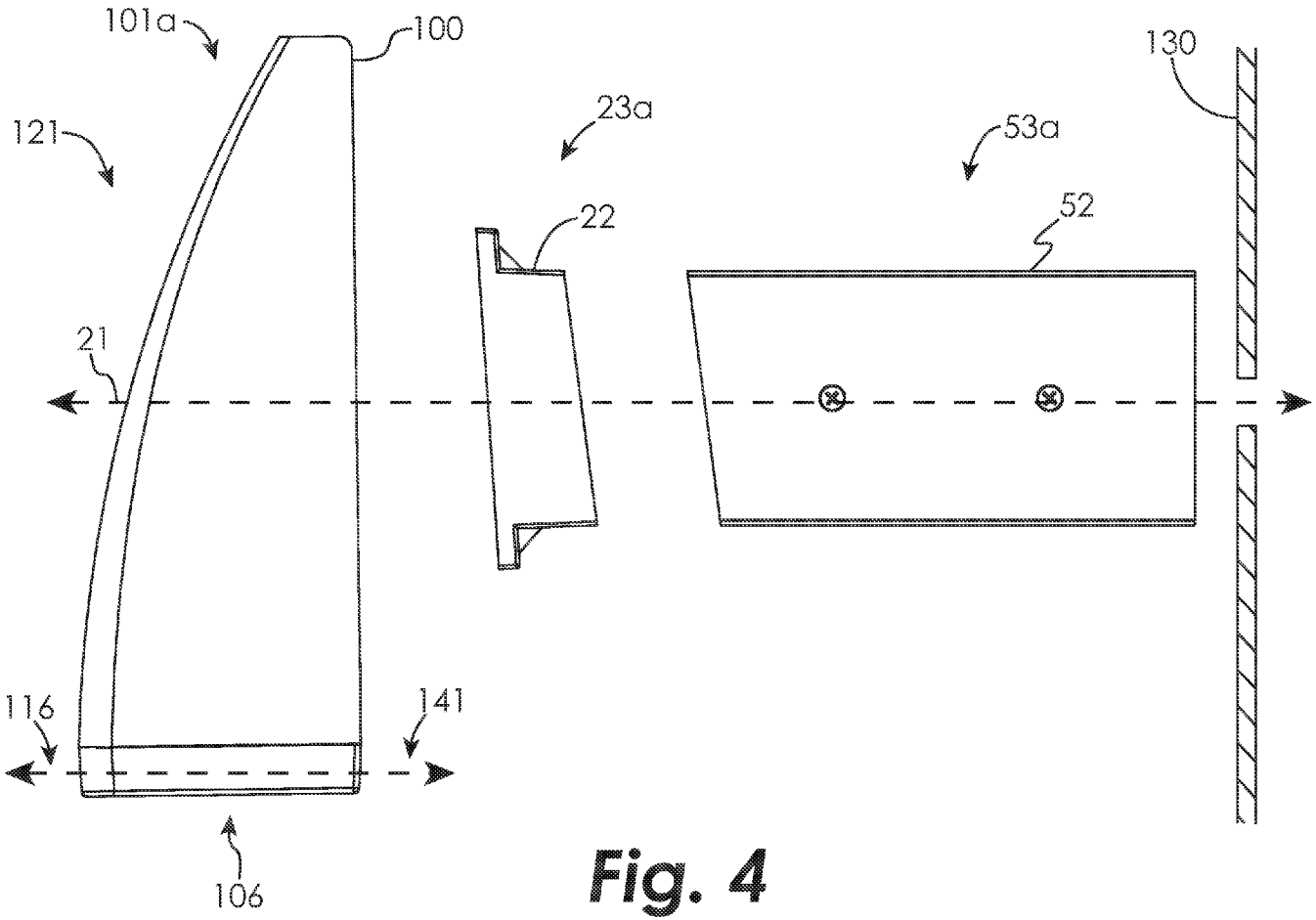
FIGS. 4-11 are side exploded views showing the relative rotational positions and arrangement of the first arm and second arm of the mounting arm and the light fixture of FIG. 1.
Figure 7:
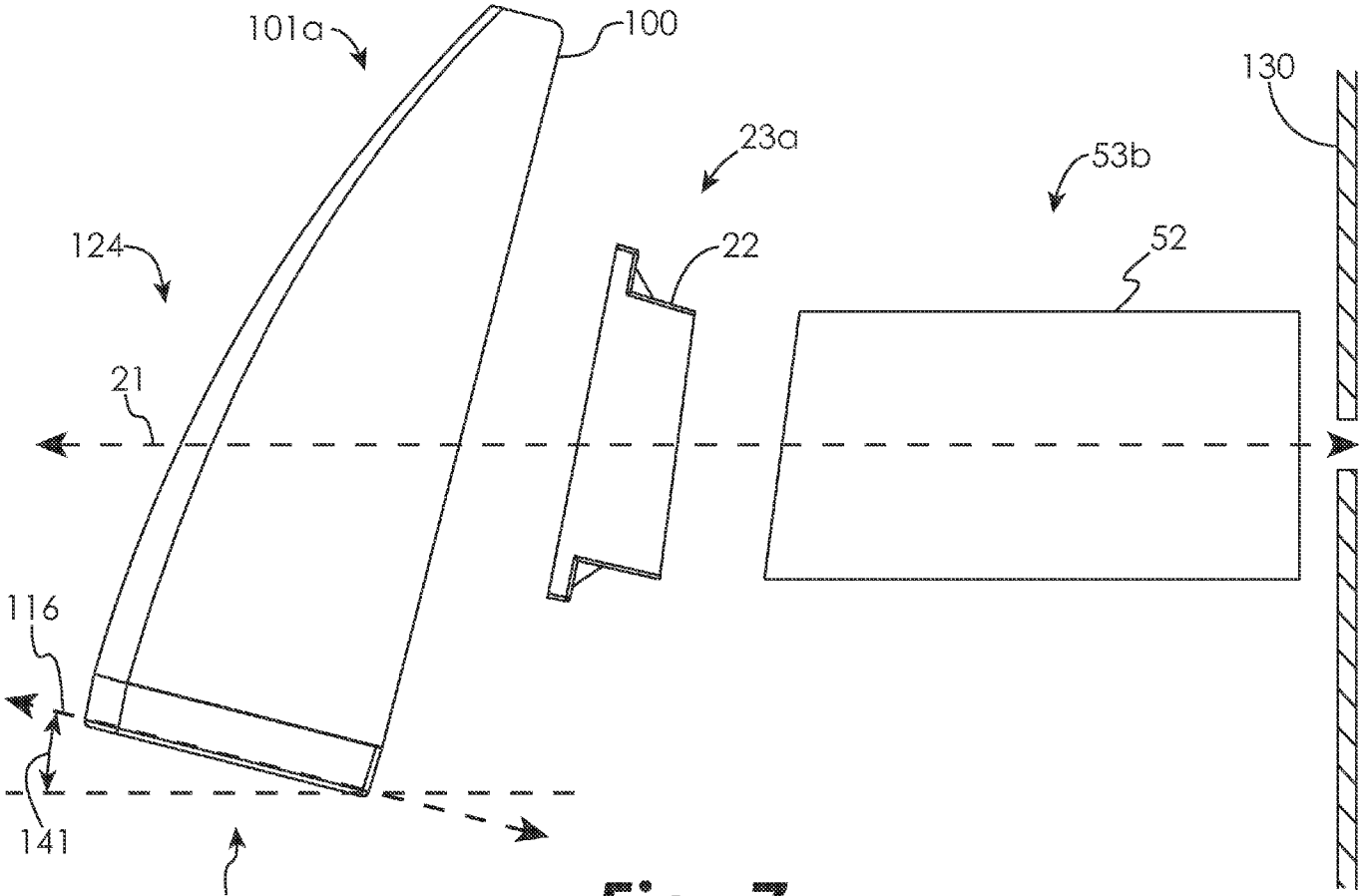
Figure 8:
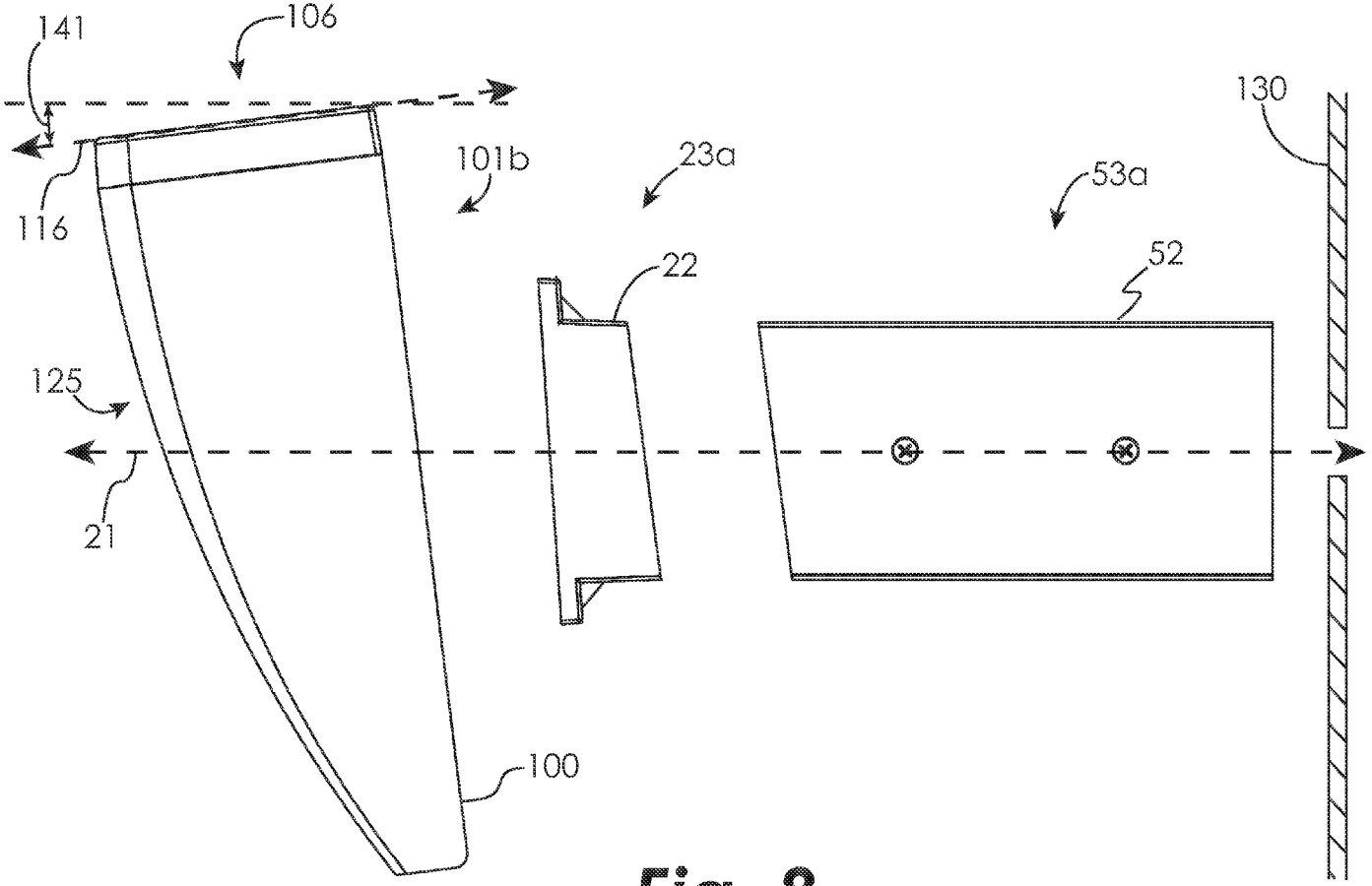

When the first arm 22 is in the first rotational position 23*a* and the second arm 52 is in the first rotational position 53*a*, as shown in FIGS. 4 and 8, the longitudinal axes 21, 24, and 54 are coaxial in the illustrative embodiment. However, other rotational orientation combinations (shown in FIGS. 5-7 and 9-11), the longitudinal axes 21, 24, and 54 may not be coaxial, for example as shown in FIG. 1; however, the longitudinal axes 21, 24, and 54 are about coaxial for the angles 29, 33, 59, 63, and 118 (FIGS. 1 and 12) used in the illustrative embodiment, all being between about 90 and about 97.5 degrees.

The possible combinations of orientations of the first arm 22, second arm 52, and light fixture 100 in the illustrative embodiment provide eight different tilt positions 121-128 (FIGS. 4-11) for the light fixture 100 relative to the support structure 130. Longitudinal axis 21 is generally perpendicular to the support structure 130 in the illustrative embodiment. Referring to FIG. 4, in tilt position 121, light fixture 100 is oriented in the first rotational position (lens downward) 101*a*, first arm 22 is oriented in the first rotational position 23*a*, and second arm 52 is oriented in the first rotational position 53*a*, providing lens plane 116 about parallel to longitudinal axis 21 so that angle 141 is about 0 degrees (a relative displacement angle for lens plane 116 from its orientation in tilt position 121), and angle 140 (FIG. 2, normal vector 115 relative to axis 21) is about 90 degrees.

Figure 5:
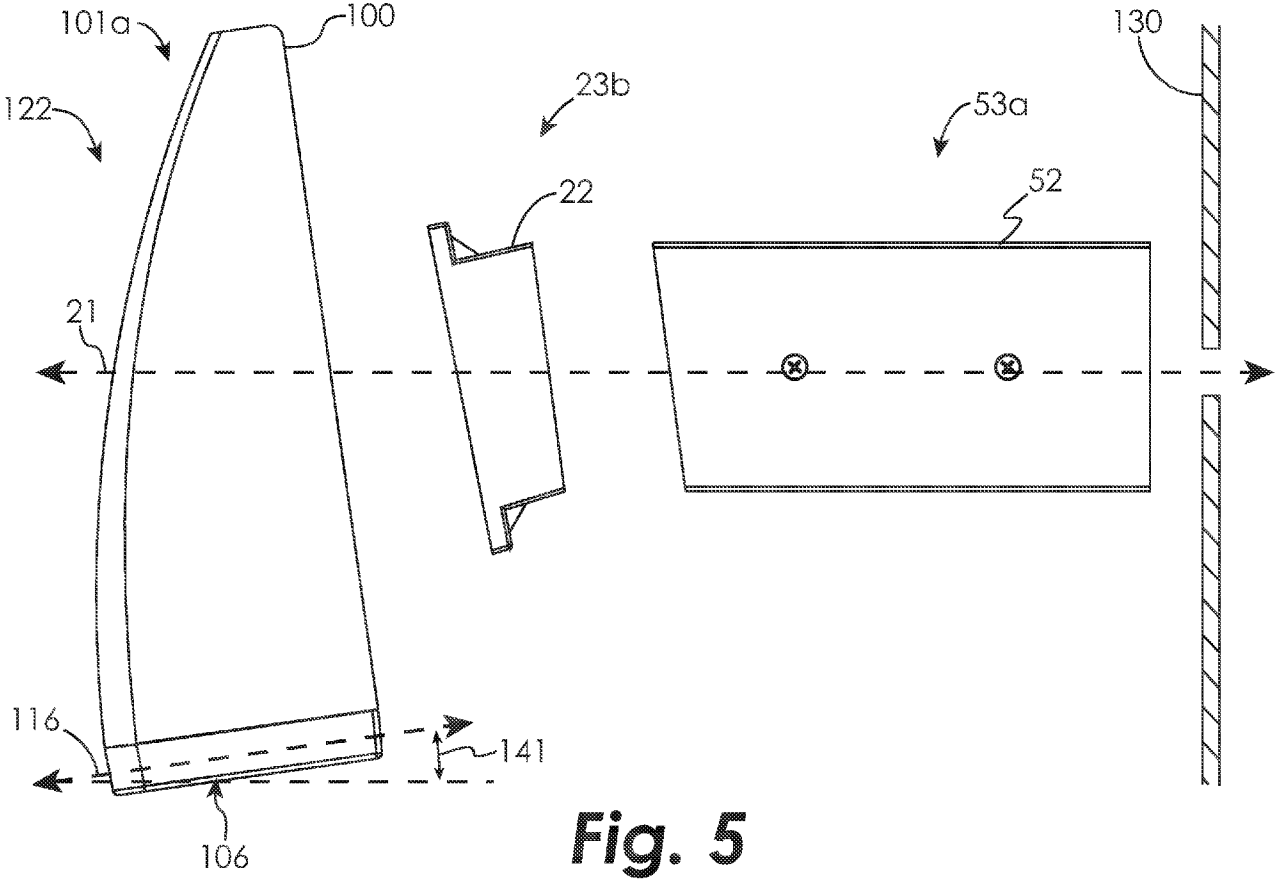

Referring to FIG. 5, in tilt position 122, light fixture 100 is oriented in the first rotational position (lens downward) 101*a*, first arm 22 has been rotated 180 degrees about longitudinal axis 21 so that it is oriented in the second rotational position 23*b* and second arm 52 is oriented in the first rotational position 53*a*, providing lens plane 116 tilted toward the support structure 130 so that angle 141 is about −7.5 degrees, and angle 140 (FIG. 2, normal line 115 relative to axis 21) is about 97.5 degrees.

Figure 6:
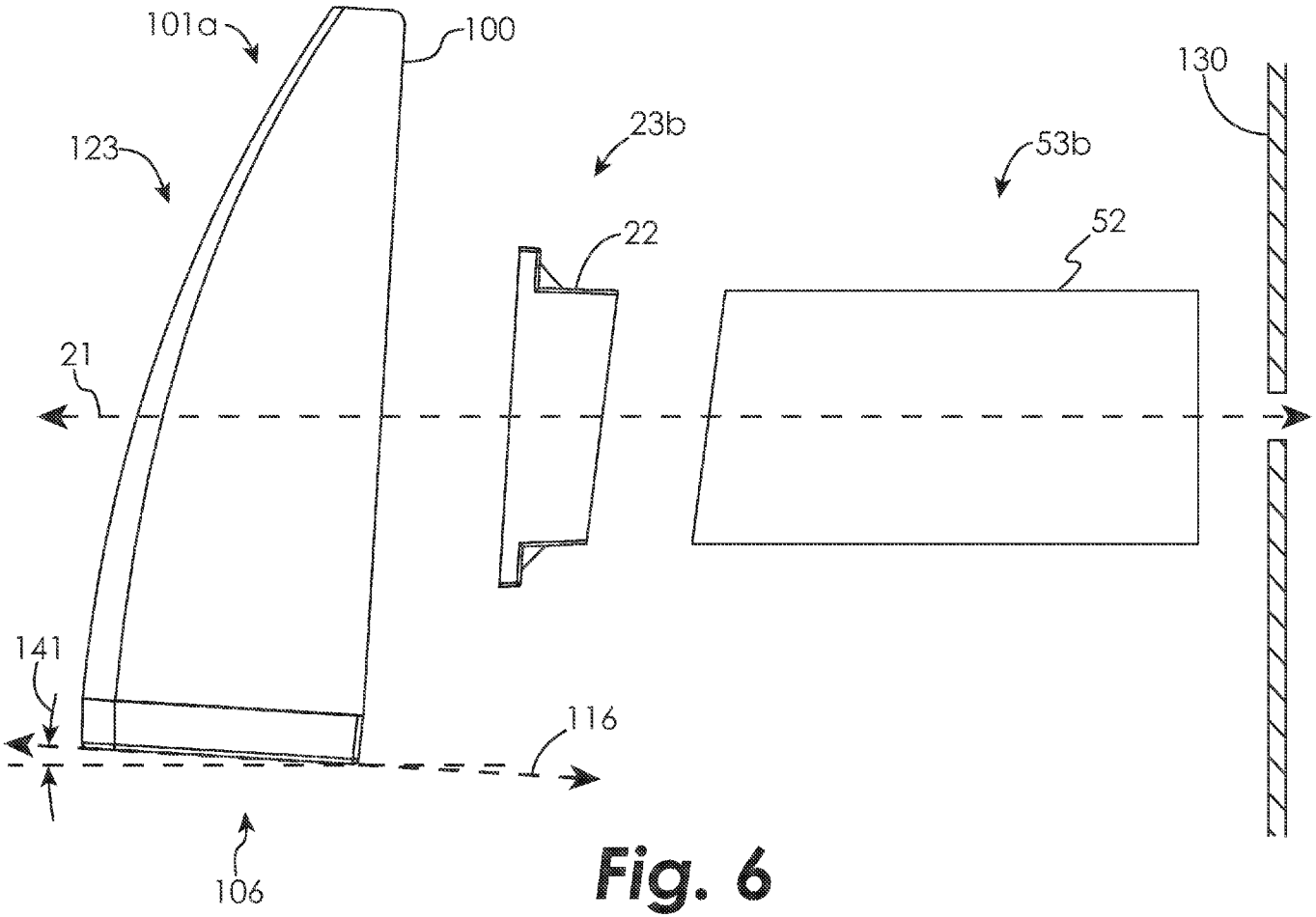

Referring to FIG. 6, in tilt position 123, light fixture 100 is oriented in the first rotational position (lens downward) 101*a*, first arm 22 has been rotated 180 degrees about longitudinal axis 21 so that it is oriented in the second rotational position 23*b* and second arm 52 has also been rotated 180 degrees so that it is oriented in the second rotational position 53*b*, providing lens plane 116 tilted away the support structure 130 so that angle 141 is about +7.5 degrees, and angle 140 (FIG. 2, normal line 115 relative to axis 21) is about 82.5 degrees.

Referring to FIG. 7, in tilt position 124, light fixture 100 is oriented in the first rotational position (lens downward) 101*a*, first arm 22 is oriented in the first rotational position 23*a* and second arm 52 is rotated 180 degrees so that it is oriented in the second rotational position 53*b*, providing lens plane 116 tilted away from the support structure 130 so that angle 141 is about +15 degrees, and angle 140 (FIG. 2, normal line 115 relative to axis 21) is about 75 degrees.

Referring to FIG. 8, in tilt position 125, light fixture 100 is rotated 180 degrees about longitudinal axis 21 so that it is oriented in the second rotational position (lens upward) 101*b*, first arm 22 is oriented in the first rotational position 23*a* and second arm 52 is oriented in the first rotational position 53*a*, providing lens plane 116 tilted away from the support structure 130 so that angle 141 is about +7.5 degrees, and angle 140 (FIG. 2, normal line 115 relative to axis 21) is about 97.5 degrees.

Figure 9:
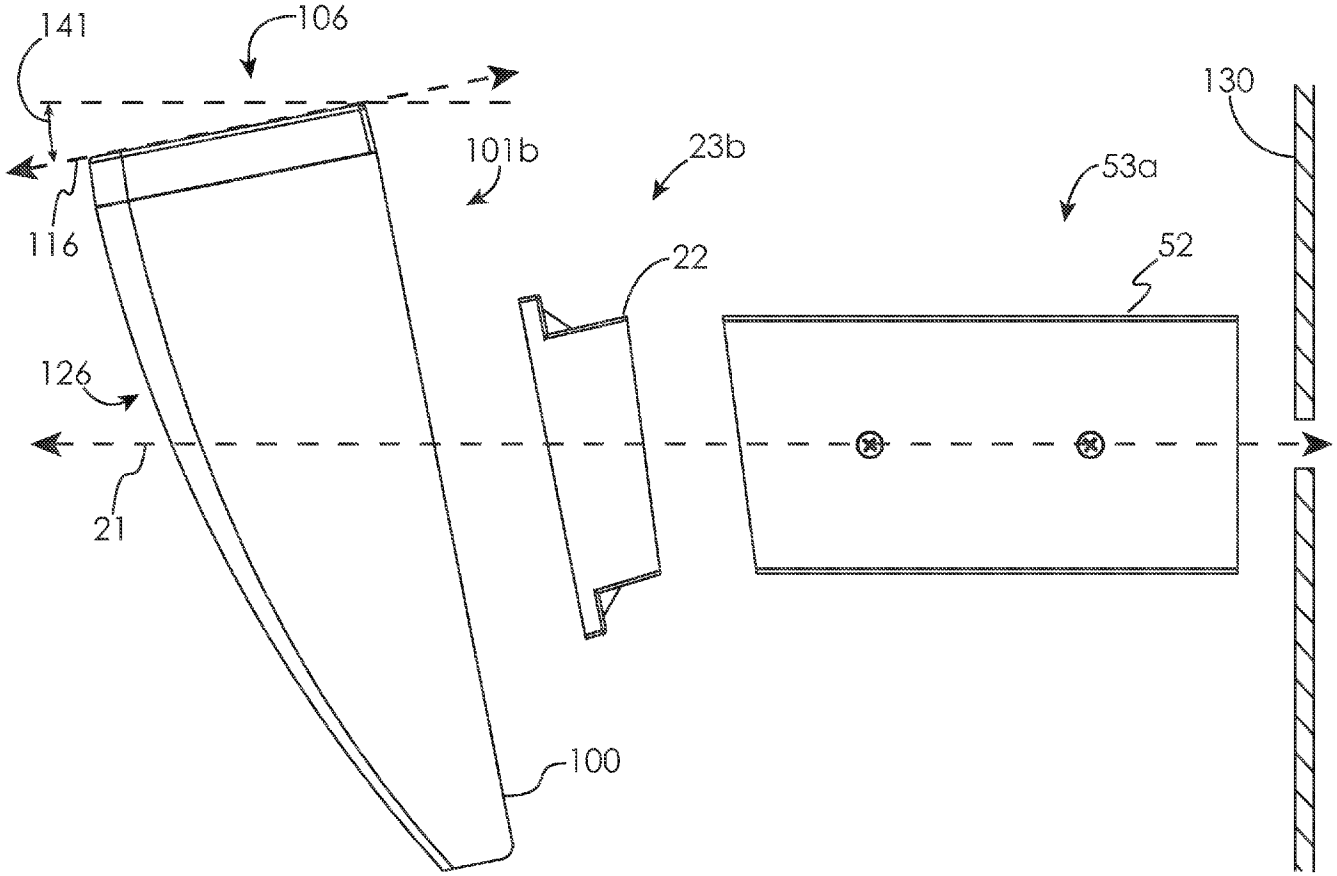

Referring to FIG. 9, in tilt position 126, light fixture 100 is oriented in the second rotational position (lens upward) 101*b*, first arm 22 is oriented in the second rotational position 23*a* and second arm 52 is oriented in the first rotational position 53*a*, providing lens plane 116 tilted away from the support structure 130 so that angle 141 is about +15 degrees, and angle 140 (FIG. 2, normal line 115 relative to axis 21) is about 105 degrees.

Figure 10:
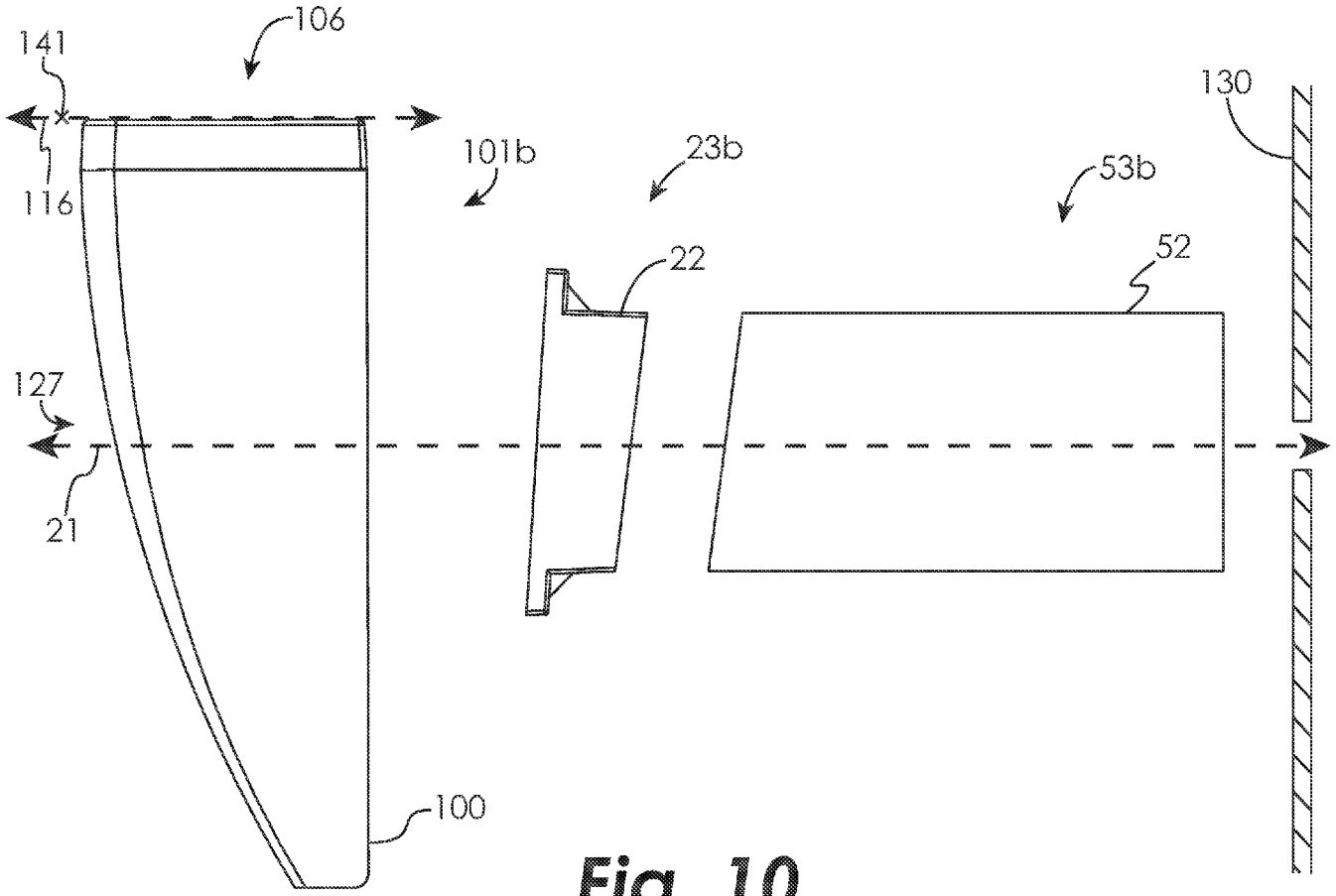

Referring to FIG. 10, in tilt position 127, light fixture 100 is oriented in the second rotational position (lens upward) 101*b*, first arm 22 is oriented in the second rotational position 23*b* and second arm 52 is oriented in the second rotational position 53*b*, providing lens plane 116 about perpendicular to the support structure 130 so that angle 141 is about 0 degrees, and angle 140 (FIG. 2, normal line 115 relative to axis 21) is about 90 degrees.

Figure 11:
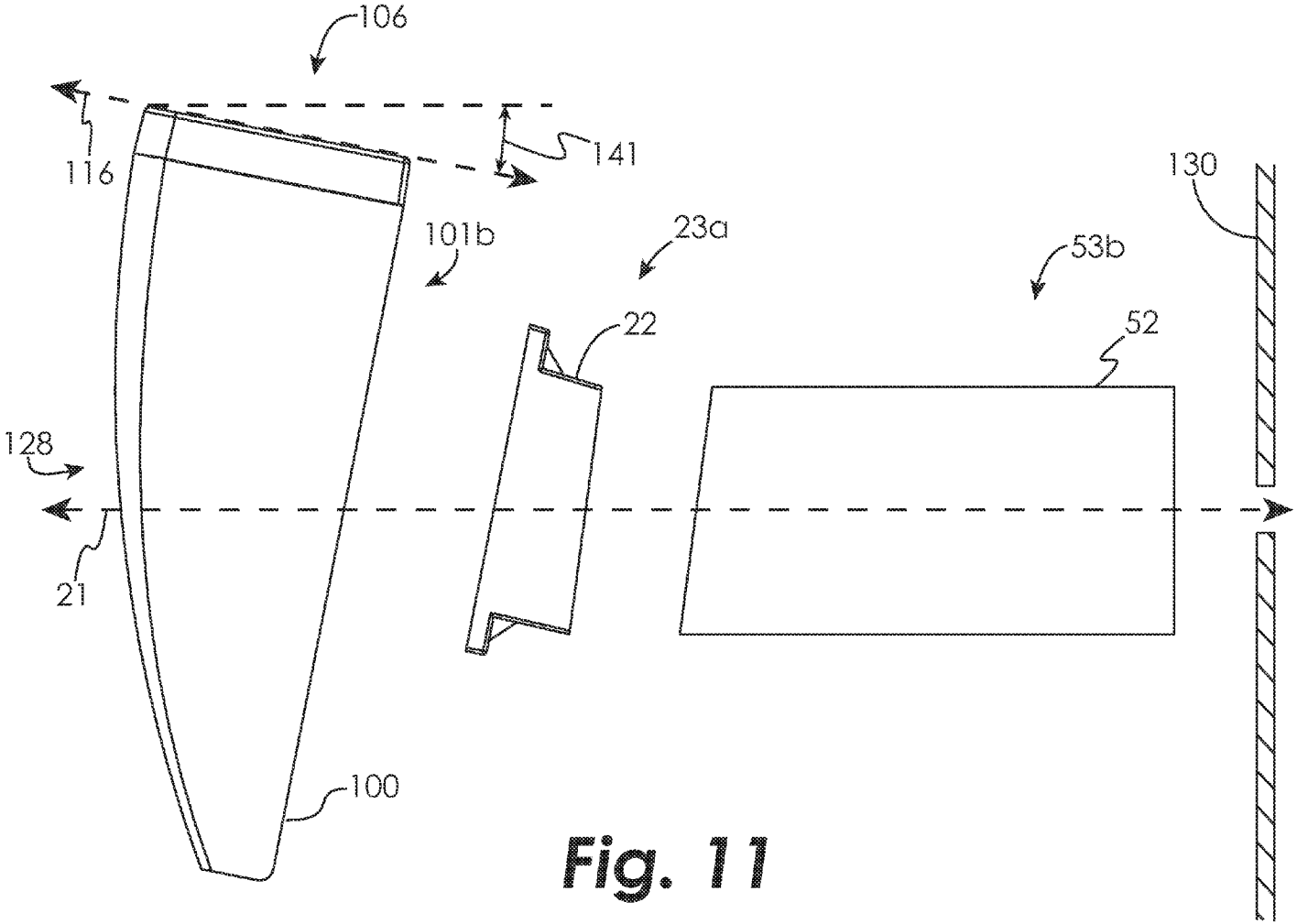

Referring to FIG. 11, in tilt position 128, light fixture 100 is oriented in the second rotational position (lens upward) 101*b*, first arm 22 is oriented in the first rotational position 23*a* and second arm 52 is oriented in the second rotational position 53*b*, providing lens plane 116 tilted toward the support structure 130 so that angle 141 is about −7.5 degrees, and angle 140 (FIG. 2, normal line 115 relative to axis 21) is about 82.5 degrees.

Figure 13:
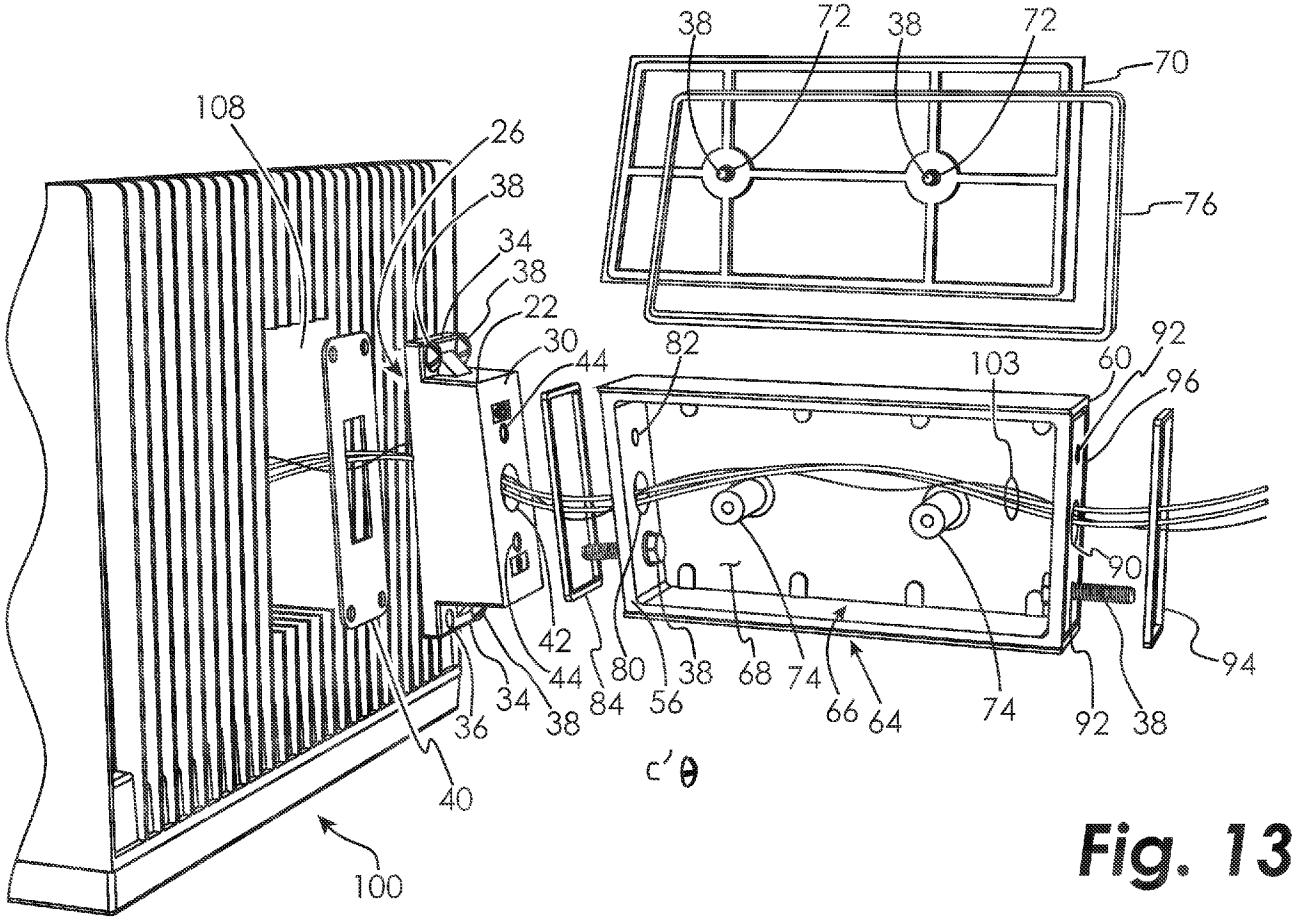
FIG. 13 is an exploded rear perspective view of the illustrative embodiment of FIG. 1.

Referring to FIG. 1 (assembled side view) and FIG. 13 (exploded side perspective view), various additional optional features in the illustrative embodiment of mounting arm 20 are shown. The first arm 22 is open on the first end 26 and closed on the second end 30. The top and bottom flanges 34 define bores 36 through which fasteners 38, for example machine screws, couple the first arm 22 to mounting pad 108, for example screws secured in tapped bores 109 (FIG. 3), either directly, or with a gasket 40 for waterproof sealing therebetween. The first end 26 and flanges 34 are sized to couple with mounting pad 108 defined on housing 102 of light fixture 100. Opening 42 is defined through second end 30 and provides passage therethrough of electrical supply wires 103. Tapped bores 44 are located in second end 30 for coupling second arm 52 to first arm 22 as described below. The first arm 22 can be constructed using other structures, coupling, and features known in the art that provide angles ends 26 and 30 for mounting between the light fixture 100 and second arm 52.

The second arm 52 is open on a front side 64 to provide an interior open cavity 66, and is closed on all other sides, including back side 68. Cover 70 is sized to enclose front side 64 and may include bores 72 through which fasteners 38, for example, machine screws with waterproof o-ring seals, pass and secure in tapped posts 74 located within cavity 66 on back side 68. A gasket 76 may be used between the cover 70 and side 64 to provide a waterproof seal. Cover 70 provides access to fasteners 38, for example machine screws, used to couple the second arm 52 to the first arm 22 and the support structure 130, and access to electrical supply wires 103.

The first end 56 of the second arm 52 may include a gasket 84 to provide a waterproof seal with the second end 30 of the first arm 52. Additionally, referring to FIG. 14B, the first end 56 can include a recess 86 for receiving a portion of the depth of the gasket 84 and retaining the gasket in position around the bores 82 and opening 80 defined in the first end 56. Bores 82 receive therethrough fasteners 38, for example machine screws, that anchor in tapped bores 44 of the first arm 22 to secure the first end 56 of the second arm 52 to the second end 30 of the second arm 30. In this coupled position, as shown in FIG. 1, the openings 80 and 42 are aligned so that the electrical supply wires 103 can pass therethrough. Similarly, the second end 60 includes opening 90 for receiving electrical supply wires 103 therethrough and bores 92 for receiving fasteners 38, for example machine screws, therethough to secure the second arm 52 to the support structure 130. Also, the second end 60 can also include a recess 96 for receiving a portion of the depth of the gasket 94 and retaining the gasket 94 in position around the bores 92 and opening 90 defined in the second end 60. The second arm 52 can be constructed using other structures, coupling, and features known in the art that provide varied angled ends 56 and 60 for mounting between the first arm 22 and the support structure 130.

Figure 14B:
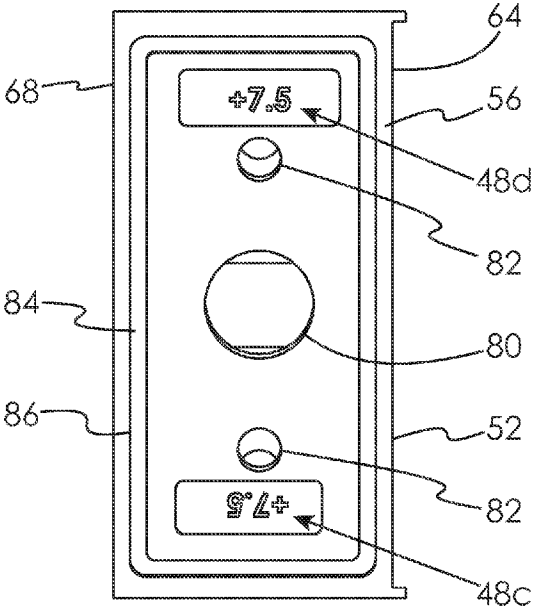
FIG. 14B is an end view of the first end of the second arm of the mounting arm of FIG. 1.
Figure 14A:
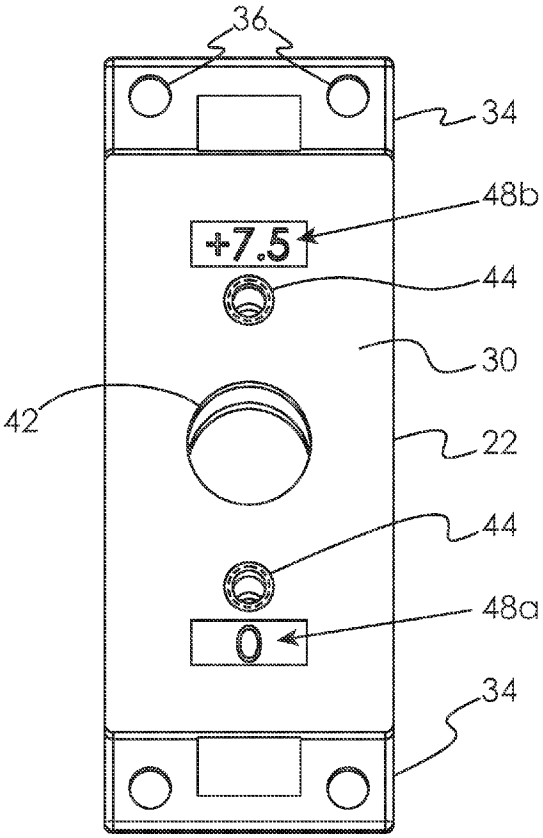
FIG. 14A is an end view of the second end of the first arm of the mounting arm of FIG. 1.

Referring to FIGS. 14A and 14B, one or more of the mounting pad 108, first end 26 and second end 30 of the first arm, and first end 56 and second end 60 of the second arm 52 can include markers 48*a-d*. As shown on the second end 30 of first arm 22 and the first end 56 of the second arm 56, in the illustrative embodiment, to aid in rotational orientation to provide a desired tilt elevation of the light fixture 100, the markers 48*a-d* indicate an incremental angular degree that is set by each arm 22 and 52 based on the selected rotational position 23*a-b* and 53*a-b* of each arm 22 and 52 respectively.

Figure 15:
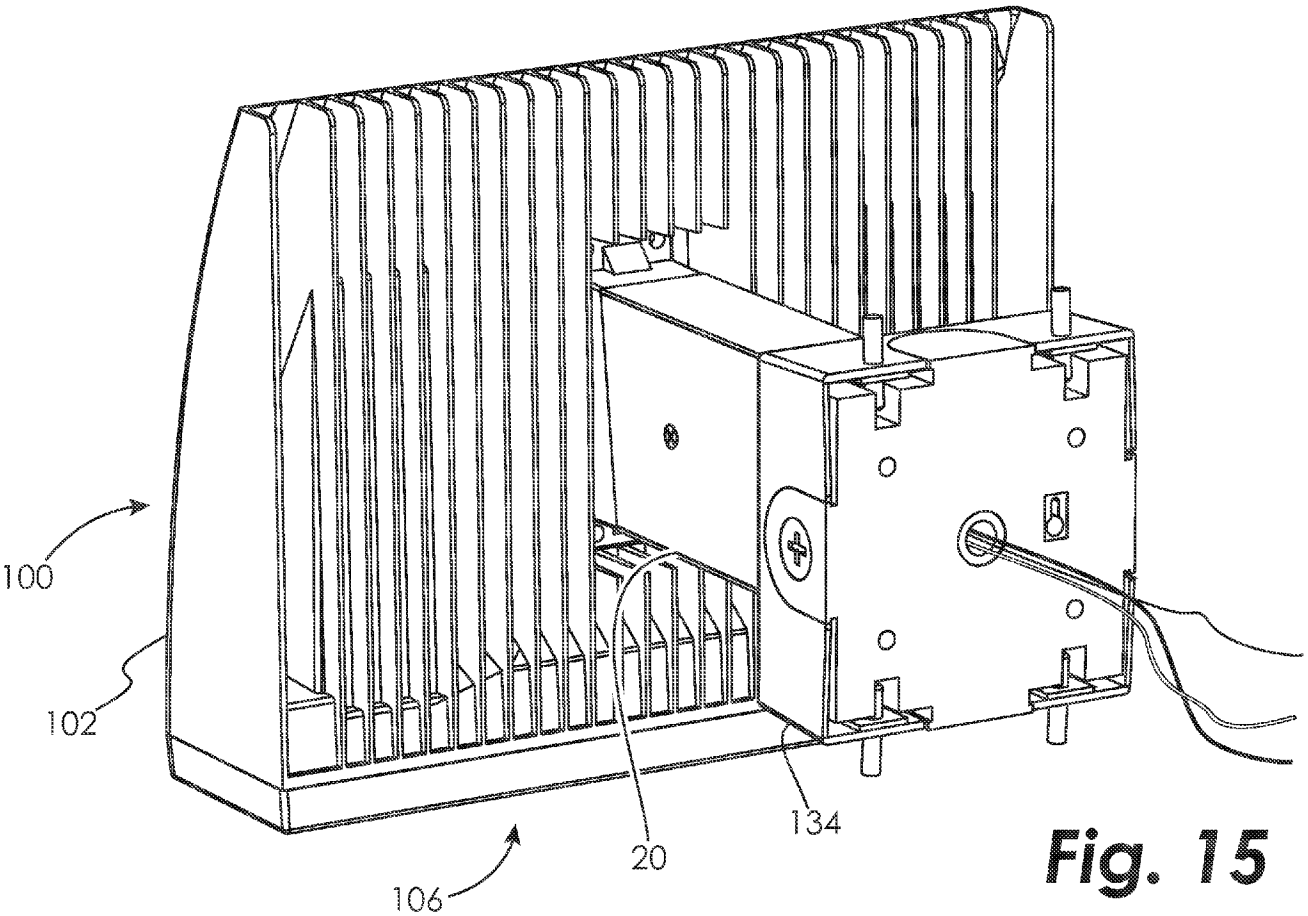
FIG. 15 is a rear perspective view of an illustrative embodiment of the mounting arm and light fixture of FIG. 1 shown with an alternative wall box mount.

Referring to FIGS. 1, 2, and 15, mounts 132, 134 or other structures known in the art can be coupled to the second end 60 of the second arm 52 and be used to couple the mounting arm 20 to a support structure 130. For example, mount 132 (FIGS. 1 and 2) is adapted to be positioned on the opposite side of a thin walled support structure 130, for example a bollard, and to securely couple the mounting arm 20 to the support structure 130, for example, with fasteners 38, such as machine screws. Alternatively, another embodiment, mount 134 (FIG. 15) is a wall box type structure and adapted to be positioned on the mounting arm 20 side of the support structure 130, for example, a wall. For example, a base plate 136 of the mount 134 can be secured to the wall, a box portion 138 coupled to the second arm 52, and the box portion 138 coupled to the base plate 136 to complete the mounting of the light fixture 100 to the support structure 130.

In an above or an alternative embodiment of the mounting arm 20, selected orientation of the first arm 22 and second arm 52 can be provided additionally or alternatively by rotation end-for-end rather than rotational twisting about longitudinal axis 21.

In the illustrative embodiment, light housing 100 and mounting arms 22 and 52 are die-cast from aluminum or an aluminum alloy, however, other rigid or semi-rigid metals or non-metals and other methods of forming can be substituted.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

The invention claimed is:

1. A mounting arm for mounting a light fixture to a support structure in a plurality of tilt positions, comprising:

a mounting pad defined by the light fixture;

a first arm portion defining a first arm first end and a first arm second end, the first arm first end coupled with the mounting pad;

a second arm portion defining a second arm first end and a second arm second end, the second arm first end coupled with the first arm second end through a non-pivotable joint, the second arm second end coupled with a support structure through a non-pivotable joint;

at least one of the first arm portion and second arm portion rotatable between a first rotational position and a second rotational position; and wherein changing an orientation of one of the first arm portion and second arm portion, from the first to the second rotational position tilts the light fixture from a first to a second of the plurality of tilt positions.

2. The mounting arm of claim 1, wherein rotational orientation of the first arm portion relative to the second arm portion provides at least the following plurality of tilt positions of the light fixture:

a first light fixture tilt position in which the first arm portion is in a first rotational position and the second arm portion is in a first rotational position;

a second light fixture tilt position in which the first arm portion is in a second rotational position and the second arm portion is in the first rotational position;

a third light fixture tilt position in which the first arm portion is in the second rotational position and the second arm portion is in a second rotational position; and a fourth light fixture tilt position in which the first arm portion is in the first rotational position and the second arm portion is in the second rotational position.

3. The mounting arm of claim 1, wherein the relative rotational orientations of the first arm portion, second arm portion, and light fixture provide at least the following plurality of tilt positions of the light fixture:

a first light fixture tilt position in which the first arm portion is in a first rotational position, the second arm portion is in a first rotational position, and the light fixture is in a downward position;

a second light fixture tilt position in which the first arm portion is in a second rotational position, the second arm portion is in the first rotational position, and the light fixture is in the downward position;

a third light fixture tilt position in which the first arm portion is in the second rotational position, the second arm portion is in a second rotational position, and the light fixture is in the downward position;

a fourth light fixture tilt position in which the first arm portion is in the first rotational position, the second arm portion is in the second rotational position, and the light fixture is in the downward position;

a fifth light fixture tilt position in which the first arm portion is in the first rotational position, the second arm portion is in the first rotational position, and the light fixture is in an upward position;

a sixth light fixture tilt position in which the first arm portion is in a second rotational position, the second arm portion is in the first rotational position, and the light fixture is in the upward position;

a seventh light fixture tilt position in which the first arm portion is in the second rotational position, the second arm portion is in the second rotational position, and the light fixture is in the upward position; and a eighth light fixture tilt position in which the first arm portion is in the first rotational position, the second arm portion is in the second rotational position, and the light fixture is in the upward position.

4. The mounting arm of claim 1, wherein a first arm first end plane is defined by the first arm first end and a first arm second end plane is defined the first arm second end, the first arm first end plane being non-parallel to the first arm second end plane.

5. The mounting arm of claim 1, wherein a second arm first end plane is defined by the second arm first end and a second arm second end plane is defined by the second arm second end, the second arm first end plane being non-parallel to the second arm second end plane.

6. The mounting arm of claim 1, further comprising:

a longitudinal arm axis defined between a center of the mounting pad and a center of the second end of the second arm portion; and wherein changing the orientation of at least one of the first arm portion and the second arm portion between the first rotational position and the second rotational position rotates the respective arm portion about 180 degrees about around the longitudinal arm axis.

7. The mounting arm of claim 6, wherein the coupled mounting pad and first arm portion and the first arm portion and second arm portion are each releasable.

8. The mounting arm of claim 6, further comprising a lens defining a lens plane; and wherein the mounting pad forms a mounting plane, and the lens plane and mounting second plane are non-orthogonal.

9. The mounting arm of claim 8, wherein the first end of the first arm portion defines a first arm first end plane which is oriented relative to the longitudinal axis of the first arm portion such that coupling of the mounting pad to the first arm first end plane positions the longitudinal axis perpendicular relative to a normal vector of the first plane of the lens.

10. The mounting arm of claim 6, wherein:

the first arm first end defines a first arm first end plane and the first arm second end defines a first aim second end plane, the first arm first end plane being non-parallel to the first arm second end plane;

the second arm first end defines a second arm first end plane and the second arm second end defines a second arm second end plane, the second arm first end plane being non-parallel to the second arm second end plane;

the orientation of each of the first arm portion and the second arm portion in one of the first and the second rotational positions provides four orientation combinations, each of the four orientation combinations providing a different relative angular orientation between the first arm first end plane and the second arm second end plane.

11. The mounting arm of claim 10, wherein the first arm second end plane is oriented relative to the longitudinal axis in a complementary angle to the second arm first end plane orientation relative to the longitudinal axis.

12. The mounting arm of claim 1, further comprising an opening defined by each of the mounting pad, first arm first end, first arm second end, second arm first end, and second arm second end, the opening sized to allow passage of electrical wiring therethrough.

13. The mounting arm of claim 1, further comprising a watertight seal between each of the mounting pad and the first arm first end and first arm second end and second arm first end, around the respective openings.

14. The mounting arm of claim 1, further comprising a watertight seal between the second arm second end and the support structure around the opening defined by the second arm second end.

15. The mounting arm of claim 1, further comprising:

a water seal; and a recess formed by one of the first arm second end and second arm first end, the recess encircling the opening defined by the same end; and wherein the water seal is positioned at least partially in the recess.

16. The mounting arm of claim 1, further comprising:

a water seal; and a recess formed by the second arm second end and the recess encircles the opening defined by the second arm second end;

wherein the water seal is positioned at least partially in the recess.

* * * * *